US009022000B2

(12) United States Patent
Kanai

(10) Patent No.: US 9,022,000 B2
(45) Date of Patent: May 5, 2015

(54) VALVE TIMING CONTROL DEVICE FOR INTERNAL COMBUSTION ENGINE

(75) Inventor: Hiroshi Kanai, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 14/241,978

(22) PCT Filed: Dec. 1, 2011

(86) PCT No.: PCT/JP2011/077822

§ 371 (c)(1),
(2), (4) Date: Feb. 28, 2014

(87) PCT Pub. No.: WO2013/080359

PCT Pub. Date: Jun. 6, 2013

(65) Prior Publication Data

US 2014/0290606 A1 Oct. 2, 2014

(51) Int. Cl.

| | |
|---|---|
| ***F01L 1/34*** | (2006.01) |
| ***F02D 13/02*** | (2006.01) |
| ***F01L 1/344*** | (2006.01) |

(52) U.S. Cl.

CPC ..... *F02D 13/02* (2013.01); *F01L 1/3442* (2013.01); *F01L 2001/34423* (2013.01); *F01L 2001/34453* (2013.01); *F01L 2001/34473* (2013.01); *F01L 2250/02* (2013.01); *F01L 2800/01* (2013.01); *F02D 13/0219* (2013.01)

(58) Field of Classification Search

CPC ..... F01L 1/3442; F01L 2001/34423; F01L 2001/34453

USPC ..... 123/90.15, 90.17; 464/160

See application file for complete search history.

(56) References Cited

U.S. PATENT DOCUMENTS

| | | | | |
|---|---|---|---|---|
| 7,506,622 | B2 * | 3/2009 | Takahashi et al. | 123/90.15 |
| 2008/0060471 | A1 | 3/2008 | Takahashi et al. | |

FOREIGN PATENT DOCUMENTS

| | | |
|---|---|---|
| JP | A-2008-69651 | 3/2008 |

* cited by examiner

*Primary Examiner* — Ching Chang
(74) *Attorney, Agent, or Firm* — Oliff PLC

(57) ABSTRACT

A valve timing control device includes: a vane rotor having a plurality of vanes; a housing having the vane rotor inside so that an advance chamber is formed on one side of each vane and a retard chamber is formed on the other side; a lock pin inserted in a cylinder provided in the vane and moves to a lock position and to an unlock position; and a feeding passage for feeding oil into the cylinder from the retard chamber adjacent to the vane provided with the cylinder to make the lock pin move to the unlock position, and controls an oil supplying unit to supply oil to each retard chamber, wherein a flow passage cross sectional area of the branch passage connected with the retard chamber linking with the cylinder is larger than a flow passage cross sectional area of the branch passage connected with the other retard chamber.

2 Claims, 3 Drawing Sheets

VALVE TIMING CONTROL DEVICE FOR INTERNAL COMBUSTION ENGINE

TECHNICAL FIELD

The present invention relates to a valve timing control device for an internal combustion engine capable of controlling a valve timing of at least one of an intake valve and an exhaust valve in the internal combustion engine.

BACKGROUND ART

Known is a variable valve timing device which retards or advances a phase of a camshaft to a crankshaft of an internal combustion engine to control a valve timing of at least one of an intake valve and an exhaust valve. For example, known is a device which comprises a vane rotor rotating integrally with the camshaft and a housing which houses the vane rotor inside and which rotates with the crankshaft, and which varies the valve timing by controlling oil pressure which is supplied to an advance chamber provided on one side of a vane of the vane rotor and a retard chamber provided on the other side of the vane. In such a device, known is a device where a clack valve is provided with a retard passage being connected with one of a plurality of retard chambers, and a pressure loss of the retard passage where the clack valve is provided is made smaller than pressure losses of the retard passages being connected with the other retard chambers (see Patent Literature 1).

CITATION LIST

Patent Literature

PTL1: 2008-069651

SUMMARY OF INVENTION

Technical Problem

The device disclosed by Patent Literature 1 is provided with a lock pin which is inserted into a through hole provided on the vane rotor, and which is capable of moving between: a lock position where the tip of the lock pin gets out from the through hole and sets in a concave portion of the housing; and an unlock position where the whole of the lock pin recedes into the through hole. The through hole is connected with the retard chamber, and the lock pin is moved to the unlock position due to oil fed into the through hole from the retard chamber. Therefore, in the case of delay in supply of necessary amount of oil to this retard chamber for moving the lock pin to the unlock position at the moment when the internal combustion engine starts up or the like, a camshaft and a crankshaft start to rotate in a state that the lock pin still stays at the lock position. Thereby, it could be difficult for the lock pin to get out from the concave portion. Patent Literature 1 fails to disclose and teach a construction that oil is supplied promptly into the retard chamber connected with the through hole, and thereby, the lock pin is made to move promptly to the unlock position.

Then, the aim of the present invention is providing a valve timing control device of an internal combustion engine which is capable of moving promptly the lock pin to the unlock position at the moment of start up of the internal combustion engine or the like.

A valve timing control device as one aspect of the present invention is a valve timing control device comprising: a first rotating body which has a plurality of vanes extending in a radial direction, and rotates with any one of a crankshaft and a camshaft in an internal combustion engine; a second rotating body which rotates with the other one of the crankshaft and the camshaft, and houses the first rotating body inside in a relatively rotatable manner so that advance chambers are formed on one side of each of the plurality of vanes of the first rotating body with respect to a circumferential direction and retard chambers are formed on the other side; an oil supplying unit which supplies oil to each of the retard chambers; a lock pin which is inserted in a cylinder provided in each of the vanes which are a part of the plurality of vanes, and moves to a lock position where a part of the lock pin sets in a concave portion provided on the second rotating body and to an unlock position where a whole of the lock pin recedes into the cylinder; and a feeding passage for feeding oil into the cylinder from the retard chamber adjacent to the vane provided with the cylinder so that the lock pin moves to the unlock position, and the valve timing control device controlling the oil supplying unit so that oil is supplied to each of the retard chambers, wherein the oil supplying unit is provided with a shared passage where oil is led from a supply source and a plurality of branch passages branching off from the shared passage and being connected with the retard chambers respectively, and a flow passage cross sectional area of at least one section of the branch passage connected with the retard chamber linking with the cylinder via the feeding passage is larger than a flow passage cross sectional area of the branch passage connected with each of the other retard chambers.

According to the valve timing control device of the present invention, it is possible to make the pressure loss of the branch passage of the retard chamber (hereinafter, sometimes called as the first retard chamber) linking with the cylinder smaller than the pressure loss of the branch passage of the other retard chambers (hereinafter, sometimes called as the second retard chamber). Thereby, since oil can be supplied to the first retard chamber on a priority basis more than the second retard chamber, it is possible to promptly increase the oil pressure of the first retard chamber. Due to this, it is possible to promptly supply oil into the cylinder and possible to promptly move the lock pin to the unlock position.

In one embodiment of the valve timing control device of the present invention, each of the retard chambers may be provided with an oil feeding port being connected with the branch passage, and a cross sectional area of the oil feeding port of the retard chamber linking with the cylinder may be larger than a cross sectional area of the oil feeding port of each of the other retard chambers. By enlarging the cross sectional area of the oil feeding port of the first retard chamber like this, it is possible to supply the oil smoothly into the first retard chamber. Due to this, it is possible to further more promptly supply the oil into the first retard chamber. Accordingly, it is possible to make the lock pin move to the unlock position further more smoothly.

DESCRIPTION OF EMBODIMENTS

Figure 1:
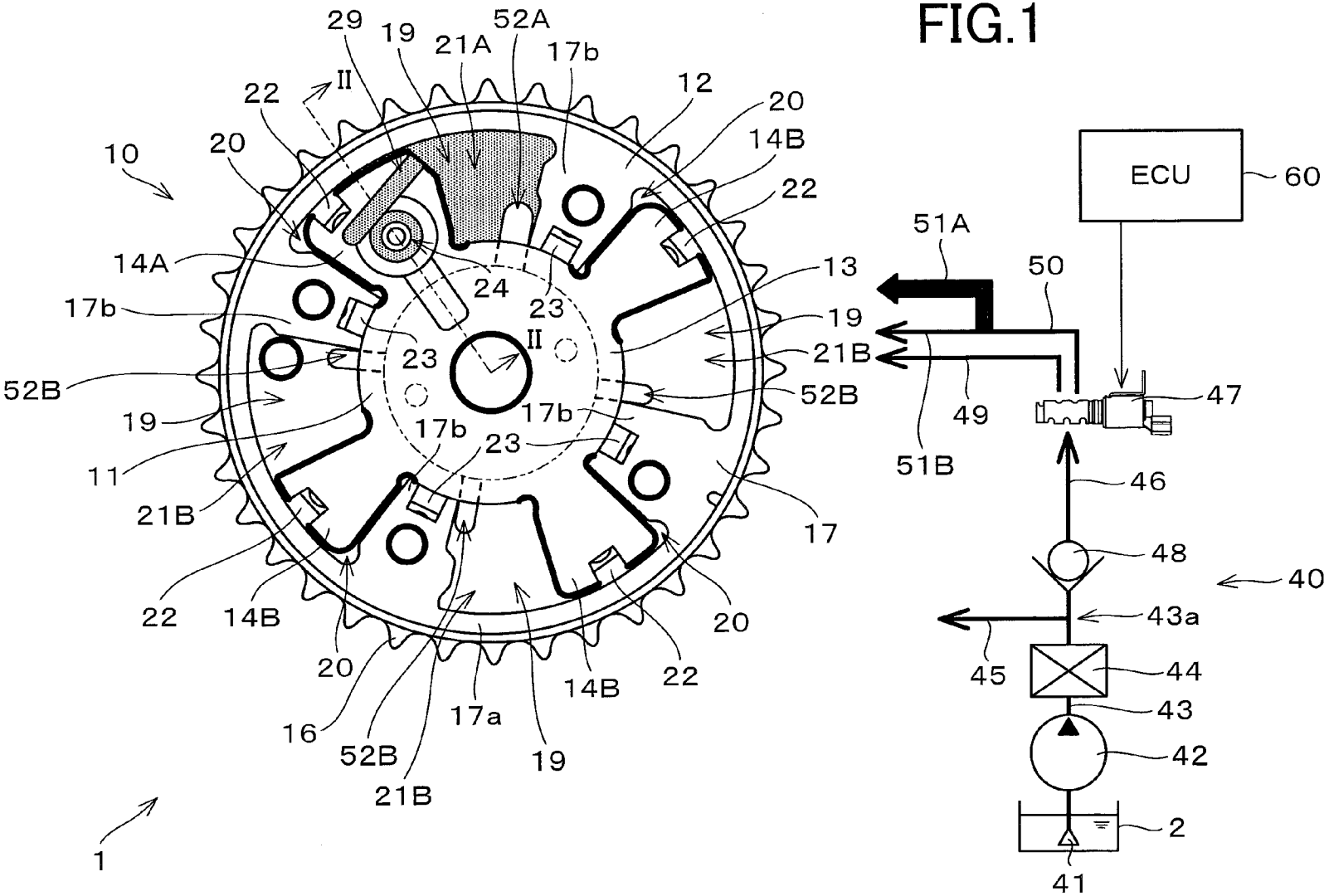
FIG. 1 is a diagram showing a main portion of an internal combustion engine where a valve timing control device according to one embodiment of the present invention is provided.

FIG. 1 shows a main portion of an internal combustion engine provided with a valve timing control device according to one embodiment of the present invention. The internal combustion engine 1 is a well-known one which has a plurality of cylinders and is mounted to a vehicle or the like as a travel power source. The internal combustion engine 1 comprises a crankshaft and a camshaft, which are not illustrated. The crankshaft is connected via a connecting rod with a piston inserted into each cylinder. On the camshaft, a plurality of cams are formed in order to open and close an intake valve provided to each cylinder.

Figure 2:
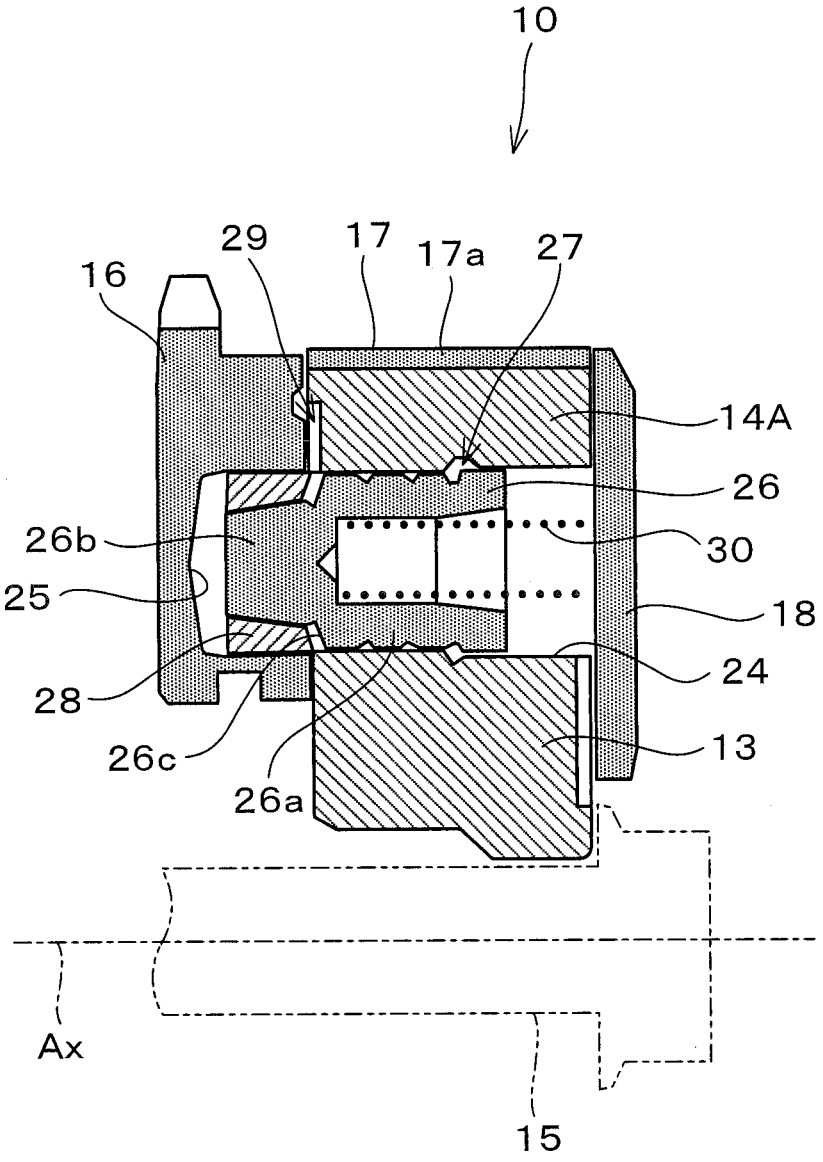
FIG. 2 is a diagram showing a cross sectional view of a phase varying mechanism taken along line II-II in FIG. 1

One end of the camshaft is provided with a phase varying mechanism 10. FIG. 2 shows a cross section of the phase varying mechanism 10 taken along line II-II of FIG. 1. As shown in FIG. 1, the phase varying mechanism 10 comprises a vane rotor 11 as a first rotating body and a housing 12 as a second rotating body in which the vane rotor 11 is housed coaxially. The vane rotor 11 is housed in the housing 12 in a rotatable manner relative to the housing 12. The vane rotor 11 comprises a rotor main body 13 having a cylindrical shape and four pieces of vanes 14 each extending from the rotor main body 13 to an outer side with respect to a radial direction. As shown in FIG. 2, the rotor main body 13 is fixed to the camshaft by a center volt 15.

The housing 12 has a sprocket 16 supported by the camshaft in a rotatable manner relative to the camshaft, a housing main body 17 and a lid portion 18. A timing chain, not illustrated, is wound around the sprocket 16 so that the housing 12 rotates with the crankshaft. As shown in FIG. 1, the housing main body 17 has: an outer wall portion 17*a* which is cylindrically shaped; and four partition portions 17*b* each extending from the outer wall portion 17*a* to an inner side with respect to the radial direction. Thereby, inside the housing main body 17, four housing chambers 19 are formed. The vane rotor 11 is combined with the housing main body 17 so that the vane 14 is arranged in the housing chamber 19. Then, as shown in FIG. 2, with respect to a direction of a rotation axis Ax, one side of the housing main body 17 is occluded by the sprocket 16, and the other side of the housing main body 17 is occluded by the lid portion 18, and thereby, the vane rotor 11 is housed in the housing 12.

Thereby, as shown in FIG. 1, an inside of each housing chamber 19 is separated into an advance chamber 20 and a retard chamber 21 by the vane 14. The end portion of an outer circumference side of each vane 14 is provided with a seal member 22. The seal member 22 occludes a gap between the vane 14 and the outer wall portion 17*a*. In addition, the end portion of an inner circumference side of each partition portion 17*b* is also provided with a seal member 23. The seal member 23 occludes a gap between the partition portion 17*b* and the rotor main body 13.

As shown in FIG. 1, one of four vanes 14 is provided with a cylinder 24. Hereinafter, sometimes in order to differentiate the vane 14 where the cylinder 24 is provided from the other vanes 14, the vane where the cylinder 24 is provided is called a first vane 14A and each of the other vanes 14 is called a second vane 14B. When it is not necessary to differentiate them from each other, each of them is called just the vane 14. As shown in FIG. 2, the cylinder 24 penetrates in the direction of the rotation axis Ax. The sprocket 16 is provided with a concave portion 25, which is opposed to the cylinder 24 when the vane rotor 11 exists at the position shown in FIG. 1 relative to the housing 12. In the cylinder 24, a lock pin 26 is inserted in a movable manner in the direction of the rotation axis Ax. The lock pin 26 has a cylindrical main body 26*a* and a tip portion 26*b* provided coaxially with the main body 26*a*. A diameter of the tip portion 26*b* is smaller than a diameter of the main body 26*a*. Due to this, a difference 26*c* is formed between the main body 26*a* and the tip portion 26*b*. The lock pin 26 is inserted in the cylinder 24 so that the tip portion 26*b* exists on the sprocket 16 side.

The lock pin 26 moves to a lock position where the tip portion 26*b* existing on the sprocket 16 side sets in the concave portion 25, and moves to an unlock position where the whole of lock pin 26 recedes into the cylinder 24. FIG. 2 shows a state that the lock pin 26 has moved to the lock position. As shown in this figure, an oil pressure chamber 27 is formed between the main body 26*a* of the lock pin 26 existing at the lock position and the vane 14. The concave portion 25 is provided with a stop member 28 so that the oil pressure chamber 27 is formed like this when the lock pin 26 exists at the lock position. The oil pressure chamber 27 is formed so that oil which is supplied in the oil pressure chamber 27 pushes the lock pin 26 to the unlock position side. The retard chamber 21 adjacent to the first vane 14A and the oil pressure chamber 27 are connected with each other by a feeding passage 29. Hereinafter, sometimes in order to differentiate the retard chamber connected with the oil pressure chamber 27 from the other retard chambers, the retard chamber connected with the oil pressure chamber 27 is called a first retard chamber 21A, and each of the other retard chambers is called a second retard chamber 21B. When it is not necessary to differentiate them from each other, each of them is called just the retard chamber 21. In the cylinder 24, provided is a spring 30 which biases the lock pin 26 to the sprocket 16 side.

The oil is supplied to each advance chamber 20 and each retard chamber 21 by an oil supplying device 40 as an oil supplying unit. As shown in FIG. 1, the oil supplying device 40 has an oil pump 42 as a supply source, which pumps up oil from an oil pan 2 of the internal combustion engine 1 via a strainer 41. The oil pump 42 is a well-known one which is driven by the internal combustion engine 1. A supply passage 43 is connected with a spout side of the oil pump 42. The supply passage 43 is provided with a filter 44 for removing a foreign material in the oil. The supply passage 43 branches at a branch point 43*a* into a main oil passage 45 and a valve oil passage 46. The main oil passage 45 leads oil to bearings supporting the crankshaft, an oil jet mechanism for cooling pistons, and the like. The valve oil passage 46 leads oil to an oil control valve 47. The valve oil passage 46 is provided with a clack valve 48. The clack valve 48 allows oil to flow from the supply passage 43 to the oil control valve 47 and inhibits oil to flow from the oil control valve 47 to the supply passage 43. The oil control valve 47 is connected with each advance chamber 20 via an advance oil passage 49. Also, the oil control valve 47 is connected with each retard chamber 21 via a retard oil passage 50. The oil control valve 47 is configured so that the valve oil passage 46 is selectively connected with one of the advance oil passage 49 and the retard oil passage 50.

The retard oil passage 50 branches into four branch passages 51 in the middle thereof. Due to this, the retard oil passage 50 corresponds to a shared passage of the present invention. Only two of four branch passages 51 are shown in this figure. Each retard chamber 21 is provided with an oil feeding port 52. The branch passage 51 is connected with the oil feeding port 52. As shown in this figure, the oil feeding port 52A of the first retard chamber 21A is formed so that a cross sectional area of the oil feeding port 52A is larger than a cross sectional area of an oil feeding port 52B of the second retard chamber 21B. In addition, the branch passage 51A connected with the first retard chamber 21A is provided with respect to the whole length of the branch passage 51A, so that a flow passage cross sectional area of the branch passage 51A is larger than a flow passage cross sectional area of the branch passage 51B connected with the second retard chamber 21B.

An operation of the oil control valve 47 is controlled by an engine control unit (ECU) 60. The ECU 60 is a computer unit including a micro processor and peripheral equipments such as RAM and ROM necessary for operations of the micro processor. The ECU 60 controls various kinds of control objects provided in the internal combustion engine 1 according to a predetermined control program, and thereby controls the internal combustion engine 1. In addition, the ECU 60 is connected with various kinds of sensors for obtaining driving statuses of the internal combustion engine 1.

Figure 3:
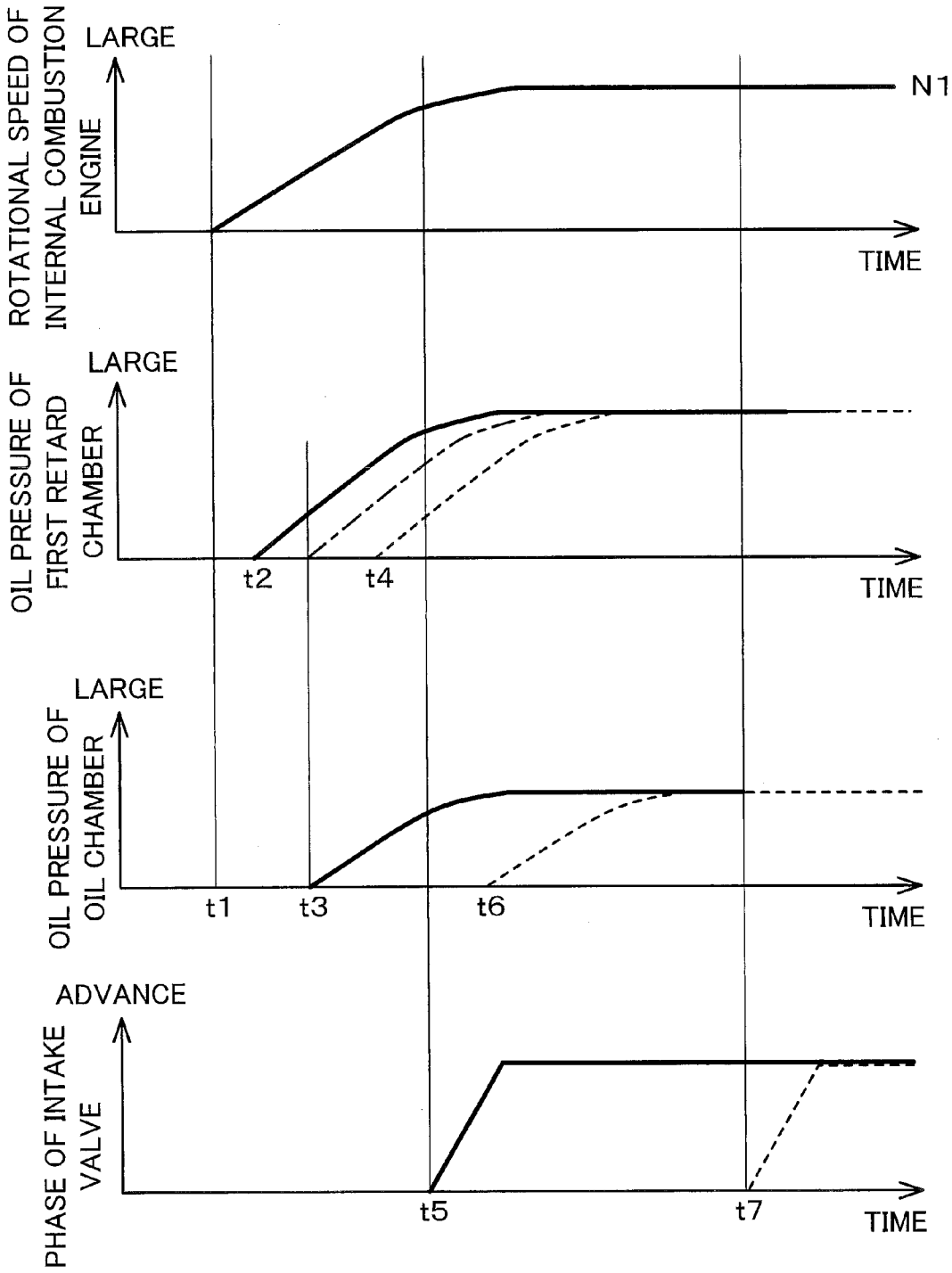
FIG. 3 is a diagram showing time variations at the moment when the internal combustion engine starts up with respect to: the rotational speed of the internal combustion engine; the oil pressure of the first retard chamber; the oil pressure of an oil pressure chamber; and the phase of the intake valve.

The ECU 60 controls operations of the oil control valve 47 so that the valve oil passage 46 and the retard oil passage 50 are connected with each other at the moment when the internal combustion engine 1 starts up. FIG. 3 shows time variations at the moment when the internal combustion engine 1 starts up, in respective the rotational speed of the internal combustion engine 1, the oil pressure of the first retard chamber 21A, the oil pressure of the oil pressure chamber 27, and the phase of the intake valve. In this figure, as a first comparative example, time variations in the oil pressure of the first retard chamber 21A and the oil pressure of the oil pressure chamber 27 in the situation that the clack valve 48 is not provided and the flow passage cross sectional area of the branch passage 51 connected with the first retard chamber 21A is the same as the flow passage cross sectional area of the branch passage 51 connected with the second retard chamber 21B are shown by dashed lines respectively. In addition, as a second comparative example, time variation in the oil pressure of the first retard chamber 21A in the situation that the clack valve 48 is provided and the flow passage cross sectional area of the branch passage 51 connected with the first retard chamber 21A is the same as the flow passage cross sectional area of the branch passage 51 connected with the second retard chamber 21B is shown by a dashed-dotted line.

As shown by the solid line in this figure, in the present invention, when the internal combustion engine 1 starts cranking at time t1, from time t2 the oil pressure of the first retard chamber 21A starts increasing. Due to this, from time t3 the oil pressure of the oil chamber 27 starts increasing. Thereby, it is possible to move the lock pin 26 to the unlock position more promptly. Accordingly, it is possible to move the vane rotor 11 at time t5 to change the phase of intake valve to the advance side. At time t5, the rotational speed of the internal combustion engine 1 is in the middle of increasing. Due to this, it is possible to move the lock pin 26 to the unlock position with the oil pressure lower than the oil pressure after the moment when the rotational speed reaches a predetermined rotational speed N1.

While, the oil pressure of the first retard chamber 21A starts increasing from time t3 in the second comparative example, and the oil pressure of the first retard chamber 21A starts increasing from time t4 in the first comparative example. Due to this, in a case of the first comparative example, the oil pressure of the oil pressure chamber 27 starts increasing from time t6. At this moment, since the rotational speed of the internal combustion engine 1 reaches the predetermined rotational speed N1, the force which is applied to the lock pin 26 increases. Due to this, the oil pressure necessary for moving the lock pin 26 increases. Accordingly, it is impossible to move the vane rotor 11 until time t7.

As mentioned above, in the present invention, the flow passage cross sectional area of the branch passage 51A connected with the first retard chamber 21A is larger than the flow passage cross sectional area of the branch passage 51B connected with the second retard chamber 21B. And, the cross sectional area of the oil feeding port 52A of the first retard chamber 21A is larger than the cross sectional area of the oil feeding port 52B of the second retard chamber 21B. Due to this, it is possible to promptly supply oil to the first retard chamber 21A at the moment when the internal combustion engine 1 starts up and the like. Accordingly, it is possible to promptly move the lock pin 26 to the unlock position. Thereby, since it is possible to promptly advance the phase of the intake valve, it is possible to promptly start up the internal combustion engine 1.

The present invention is not limited to only the above embodiment, but also can be realized in various embodiments. For example, it is not necessary that the flow passage cross sectional area of the branch passage connected with the first retard chamber is larger with respect to the whole length of the branch passage than the flow passage cross sectional area of the branch passage connected with the second retard chamber. It is enough that the flow passage cross sectional area of the branch passage connected with the first retard chamber is larger with respect to at least one section of the branch passage, so that the pressure loss of the branch passage connected with the first retard chamber is smaller than the pressure loss of the branch passage connected with the second retard chamber.

In the present invention, the number of lock pins is not limited to one and may be at least two. However, the number of lock pins must be less than the number of vanes of the vane rotor. Thereby, it is possible to provide the vane rotor including a vane having the lock pin and a vane having no lock pin.

In the present invention, the vane rotor may rotate with the crankshaft and the housing may rotate with the camshaft. In the present invention, it is not necessary to supply oil to the advance chambers and the retard chambers by the oil supplying device shared by them. For example, each of an oil supplying device for supplying oil to the advance chamber and an oil supplying device for supplying oil to the retard chamber may be provided independently.

The invention claimed is:

1. A valve timing control device comprising:

a first rotating body which has a plurality of vanes extending in a radial direction, and rotates with any one of a crankshaft and a camshaft in an internal combustion engine;

a second rotating body which rotates with the other one of the crankshaft and the camshaft, and houses the first rotating body inside in a relatively rotatable manner so that advance chambers are formed on one side of each of the plurality of vanes of the first rotating body with respect to a circumferential direction and retard chambers are formed on the other side;

an oil supplying unit which supplies oil to each of the retard chambers;

a lock pin which is inserted in a cylinder provided in each of the vanes which are a part of the plurality of vanes, and moves to a lock position where a part of the lock pin sets in a concave portion provided on the second rotating body and to an unlock position where a whole of the lock pin recedes into the cylinder; and a feeding passage for feeding oil into the cylinder from the retard chamber adjacent to the vane provided with the cylinder so that the lock pin moves to the unlock position, and the valve timing control device controlling the oil supplying unit so that oil is supplied to each of the retard chambers, wherein the oil supplying unit is provided with a shared passage where oil is led from a supply source and a plurality of branch passages branching off from the shared passage and being connected with the retard chambers respectively, and a flow passage cross sectional area of at least one section of a branch passage connected with a retard chamber linking with the cylinder via the feeding passage is larger than a flow passage cross sectional area of the branch passage connected with each of the other retard chambers.

2. The valve timing control device according to claim 1, wherein each of the retard chambers is provided with an oil feeding port being connected with each branch passage, and a cross sectional area of an oil feeding port of a retard chamber linking with the cylinder is larger than a cross sectional area of the oil feeding port of each of the other retard chambers.

* * * * *